US007121807B2

(12) United States Patent
Cho et al.

(10) Patent No.: US 7,121,807 B2
(45) Date of Patent: Oct. 17, 2006

(54) AXIAL-FLOW FAN

(75) Inventors: Kyungseok Cho, Daejeon-si (KR); Seyoung Park, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 10/547,409

(22) PCT Filed: Mar. 5, 2004

(86) PCT No.: PCT/KR2004/000464

§ 371 (c)(1),
(2), (4) Date: Aug. 30, 2005

(87) PCT Pub. No.: WO2004/079202

PCT Pub. Date: Sep. 16, 2004

(65) Prior Publication Data

US 2006/0165526 A1 Jul. 27, 2006

(30) Foreign Application Priority Data

Mar. 5, 2003 (KR) ..... 10-2003-0013768

(51) Int. Cl.
*F04D 29/38* (2006.01)

(52) U.S. Cl. ..... 416/242; 416/DIG. 2

(58) Field of Classification Search ..... 416/169 A, 416/242, 238, 243, 223 R, DIG. 2, DIG. 5, 416/189

See application file for complete search history.

(56) References Cited

U.S. PATENT DOCUMENTS 4,684,324 A 8/1987 Perosino
4,737,077 A * 4/1988 Vera ..... 416/242
5,961,289 A * 10/1999 Lohmann ..... 416/242
6,908,287 B1 6/2005 Cho et al.

FOREIGN PATENT DOCUMENTS

KR 2000-0047976 A 7/2000

* cited by examiner

*Primary Examiner*—Richard A. Edgar
(74) *Attorney, Agent, or Firm*—Fulbright & Jaworski L.L.P.

(57) ABSTRACT

Disclosed is an axial-flow fan having a central hub coupled to a rotational shaft of a motor, a plurality of blades extending radially outwardly from the outer circumference of the hub for blowing air in an axial direction, the plurality of blades being integrated with the hub into a single body, and a circular fan band fixedly coupled to the peripheral ends of the plurality of blades for surrounding the plurality of blades, each of the plurality of blades having a leading edge line (L.E.L.) and a trailing edge line (T.E.L.) that are formed in a corrugated shape along almost the same direction to each other and have at least two or more pairs of inflection points formed along the lines, wherein the inflection points of the trailing edge line (T.E.L.) formed on each of the plurality of blades are placed in such a manner as to be closer to a blade tip than those of the leading edge line (L.E.L.) formed on each of the plurality of blades.

6 Claims, 9 Drawing Sheets

Prior Art

Prior Art

Prior Art

Prior Art

AXIAL-FLOW FAN

This application is a § 371 of PCT/KR2004/000464 filed Mar. 5, 2004, and claims priority from Korean Patent Application No. 10-2003-0013768 filed Mar. 5, 2003.

TECHNICAL FIELD

The present invention relates to an axial-flow fan, and more particularly, to an axial-flow fan in which a stream of airflow through the fan is produced around an engine, without any direct collision against the engine in an engine room and is not recirculated to a heat exchanger, thereby greatly improving performance of the heat exchanger such that engine cooling is achieved efficiently.

BACKGROUND ART

An axial-flow fan includes a circular central hub and a plurality of blades radially arranged along the circumference of the hub, and as well known to those skilled in the art, the axial-flow fan is a kind of fluid machinery which serves to blow air in the axial direction thereof by the rotation of the plurality of the blades. A representative example of the axial-flow fan is a cooling fan that blows air for heat radiation to an air-cooled heat exchanger to promote heat radiation of the air-cooled heat exchanger, such as an electric fan, a ventilation fan, and a radiator or condenser of an automobile. The axial-flow fan that is used as the cooling fan of the heat exchanger in the air conditioning system of the automobile is mounted at the rear or front side of the heat exchanger in conjunction with a shroud that is provided with a bell-mouthed ventilating port that is surrounded around the shroud and a plurality of airflow guide vanes that serve to guide the air blown by the blades of the fan to an axial direction from the front or the rear side of the ventilating port.

The axial-flow fan may be classified into a pusher-type axial-flow fan assembly and a puller-type axial-flow fan assembly in accordance with the arranged positions with respect to the heat exchanger.

A conventional axial-flow fan 10 of an automobile is mounted in the front of the heat exchanger in conjunction with a shroud surrounding the blades of the fan and guiding air toward the axial direction. As shown in FIGS. 1 and 2, the axial-flow fan 10 includes a central hub 12 coupled to a rotational shaft of a motor (not shown), a plurality of blades 11 extending radially outwardly from the outer circumference of the hub 12, and a circular fan band 13 fixedly coupled to the peripheral ends of the plurality of blades 11 for surrounding the plurality of blades 11. The axial-flow fan is generally made of synthetic resin and integrated with the blades 11 into a single body. The plurality of blades 11 that are curved in the plane of the fan 10 are rotated as the motor is rotated, thereby producing a difference pressure according to a variation in the airflow velocity between the front and rear sides of the fan. Thus, the axial-flow fan blows air to the axial direction thereof.

Therefore, the plurality of blades 11 may have a great effect on a blowing efficiency and the amount of generated noise in the axial-flow fan 10. As shown in FIG. 8, the terms used to describe the blades 11 of the axial-flow fan 10 are defined. The axial-flow fan 10 should be designed in view of a variety of important blade designing factors, such as setting angle of the blades 11, camber ratio, cross-directional curvature, chord length, axial-directional inclination angle, leading edge line (L.E.L) and trailing edge line (T.E.L).

The camber ratio is obtained by dividing a maximum camber value into a chord length.

The setting angle is obtained by subtracting a stagger angle at which each blade 11 is erected from 90°.

According to the prior art that has been developed in consideration with the above designing factors, as shown in FIG. 3, the trailing edge line and the leading edge line of each of the plurality of blades 11 has a plurality of inflection points formed in the same direction to one another, and each inflection point of the trailing edge line and each inflection point of the leading edge line are formed on the same radius (RT3=RL3, RT2=RL2 and RT1=RL1) from the central point of the hub 12.

By the way, for the conventional axial-flow fan as constructed above, a stream of airflow is inclined to be directed straightly along an axial direction thereof, as shown in FIG. 4.

Therefore, there is a high possibility that the airflow may collide against the engine block in the engine room at a relatively high temperature. If such a situation occurs, air becomes hot and flows back to be recirculated to the front side of the heat exchanger. This makes the temperature of air introducing to the axial-flow fan substantially raised. Thus, the cooling performance of the heat exchanger becomes deteriorated.

DISCLOSURE OF INVENTION

Accordingly, the present invention has been made to solve the above-described problems, and it is an object of the present invention to provide an axial-flow fan in which a stream of airflow through the fan is produced around an engine, without any direct collision against the engine in an engine room and is not recirculated to a heat exchanger, thereby greatly improving performance of the heat exchanger such that engine cooling is achieved efficiently.

To accomplish the above object, according to the present invention, there is provided an axial-flow fan having a central hub coupled to a rotational shaft of a motor, and a plurality of blades extending radially along the circumference of the hub for blowing air toward an axial direction, the plurality of blades integrated with the hub into a single body, and each of the plurality of blades having a leading edge line and a trailing edge line that are in a corrugated shape along almost the same direction to each other and have at least two or more pairs of inflection points formed along the lines, wherein the inflection points of the trailing edge line on each of the plurality of blades are placed in such a manner as to be closer to a blade tip than the inflection points of the leading edge line thereon.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Now, an explanation of the preferred embodiment of the present invention will be in detail given with reference to attached drawings.

Figure 5:
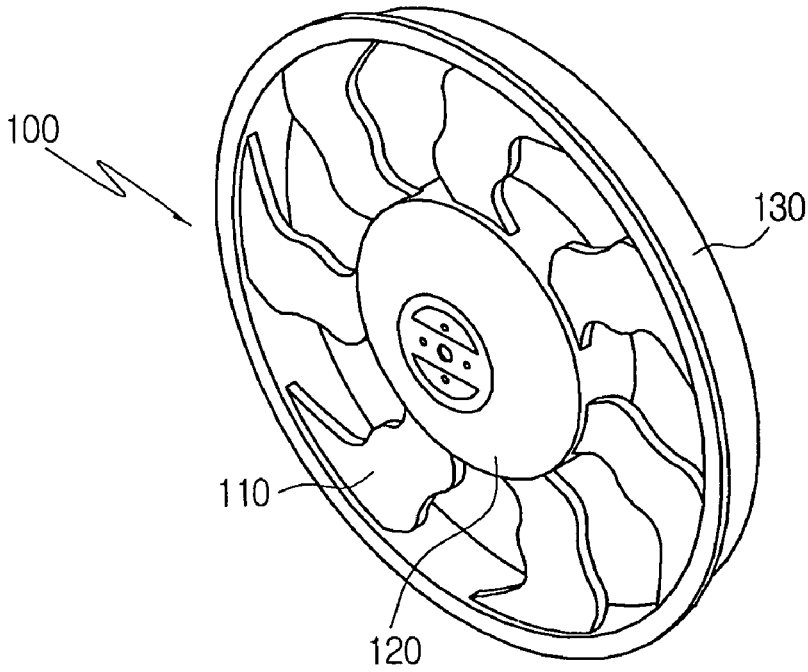
FIG. 5 is a perspective view of the outer appearance of an axial-flow fan according to the present invention.
Figure 6:
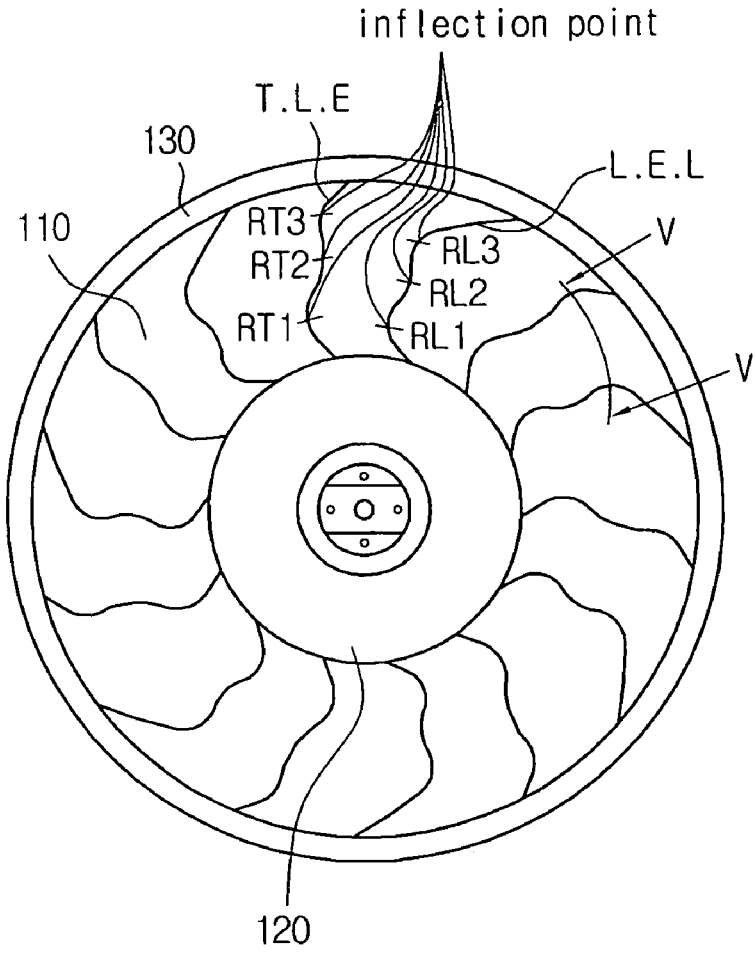
FIG. 6 is a front view of FIG. 5.
Figure 7:
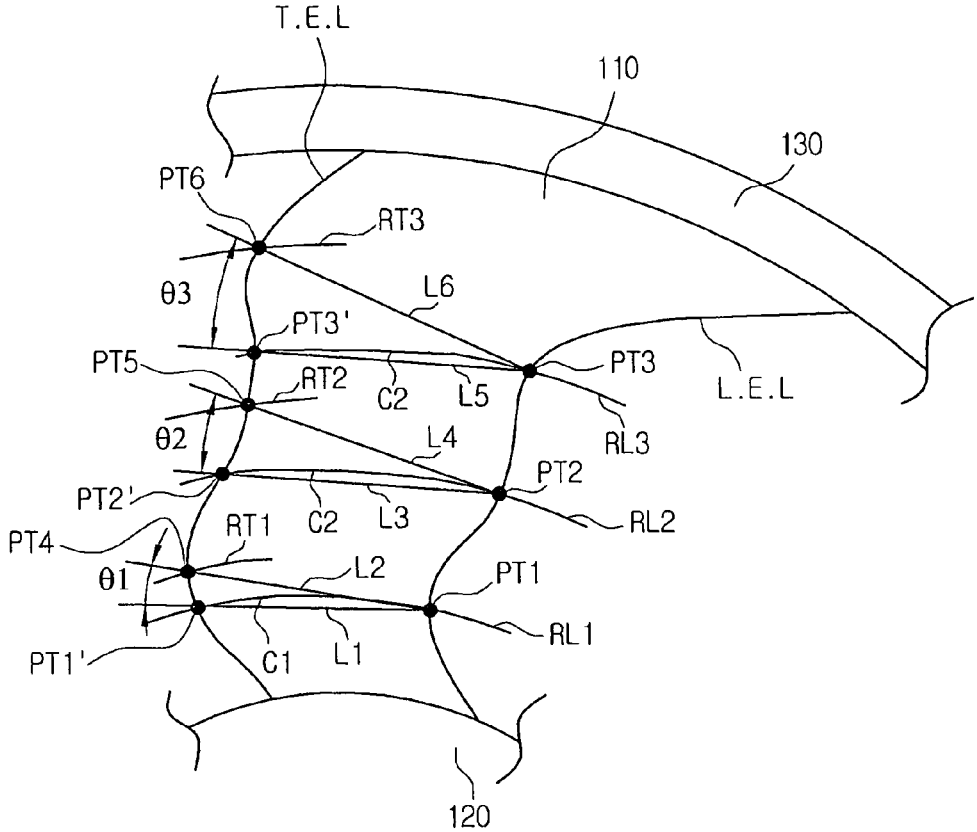
FIG. 7 is an enlarged front view of a part of the plurality of blades of FIG. 6.
Figure 8:
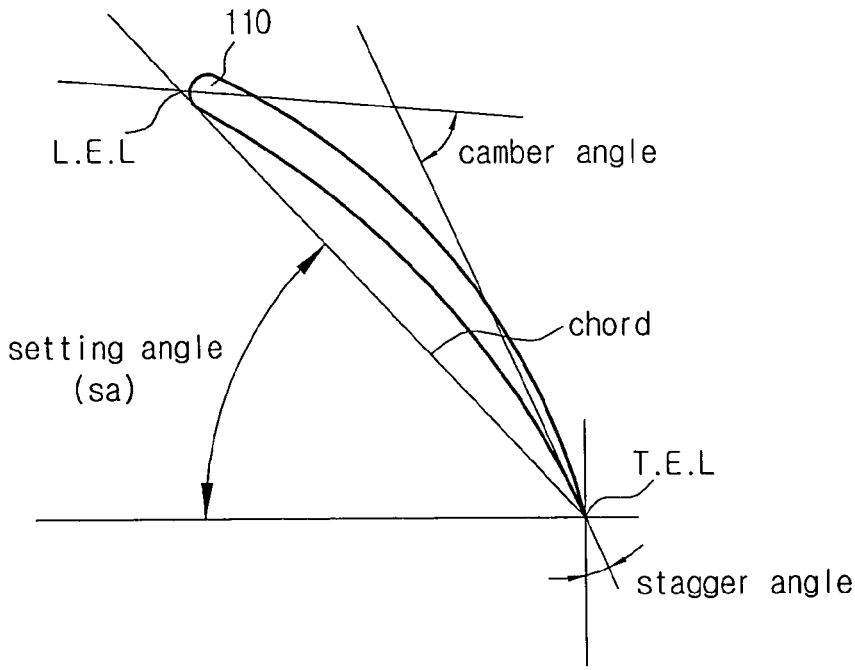
FIG. 8 is a sectional view taken along the line V—V in FIG. 6, wherein the terms used to describe the blades of the axial-flow fan are defined.
Figure 9:
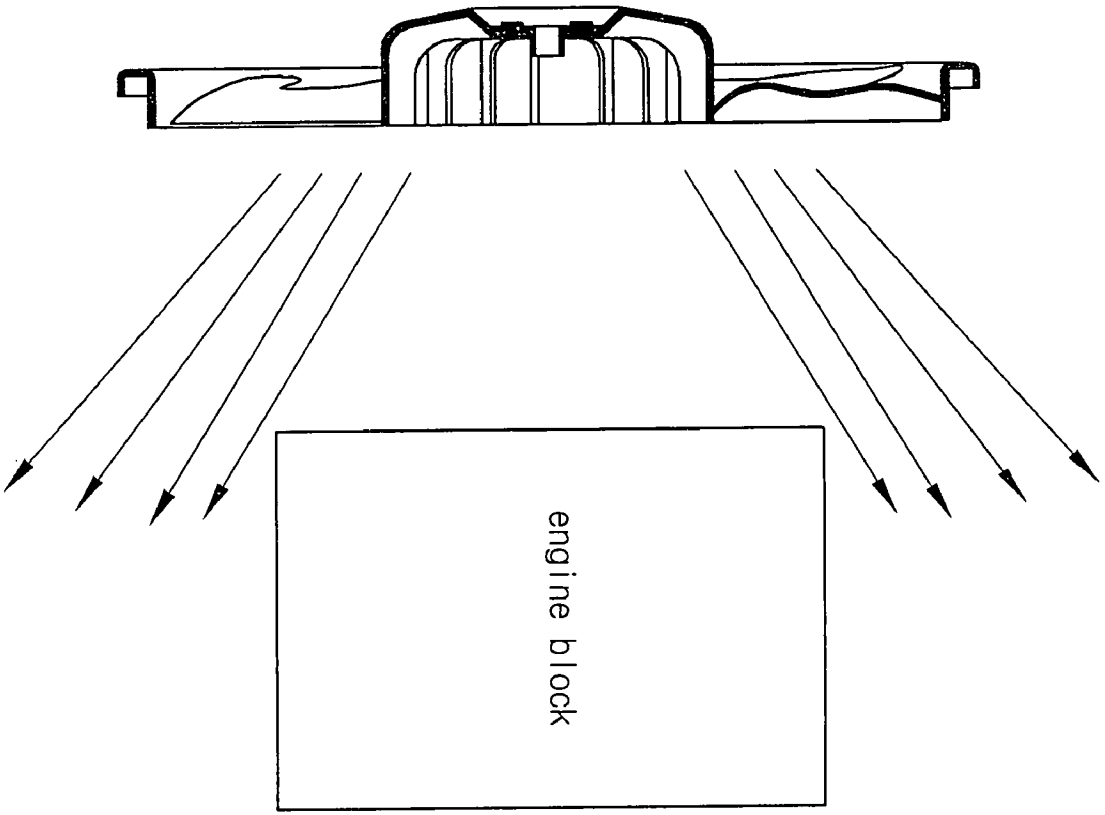
FIG. 9 is a view illustrating the direction of airflow through the axial-flow fan of FIG. 5.

FIG. 5 is a perspective view of the outer appearance of an axial-flow fan according to the present invention, FIG. 6 is a front view of FIG. 5, FIG. 7 is an enlarged front view of a part of the plurality of blades of FIG. 6, FIG. 8 is a sectional view taken along the line V—V in FIG. 6, wherein the terms used to describe the blades of the axial-flow fan are defined, and FIG. 9 is a view illustrating the direction of airflow through the axial-flow fan of FIG. 5.

An axial-flow fan 100 according to the present invention includes a central hub 120 coupled to a rotational shaft of a motor (not shown), a plurality of blades 110 extending radially outwardly from the outer circumference of the hub 120 for blowing air toward an axial direction, the plurality of blades 110 being integrated with the hub into a single body, and a circular fan band 130 fixedly coupled to the peripheral ends of the plurality of blades 110 for surrounding the plurality of blades 110.

Each of the plurality of blades 110 has a leading edge line (L.E.L) and a trailing edge line (T.E.L) that are formed in a corrugated shape.

According to the present invention, the leading edge line (L.E.L) and the trailing edge line (T.E.L) of each of the plurality of blades 100 are in a corrugated shape along almost the same direction to each other and have at least two or more pairs of inflection points formed along the lines.

In this manner, the inflection point of the trailing edge line (T.E.L) on the pair of inflection points is placed in such a manner as to be closer to a blade tip than the inflection point of the leading edge line (L.E.L) thereof.

In case of each pair of inflection points, a ratio of radius RT ranging from the central point of the hub 120 to the inflection point of the trailing edge line (T.E.L) to radius (RL) ranging from the central point of the hub 120 to the inflection point of the leading edge line (L.E.L) satisfies a condition of $1<RT/RL<1.26$.

In more detail, when there are radius RT1, RT2 and RT3 ranging from the central point of the hub 120 to the inflection points of the trailing edge line T.E.L. and radius ranging RL1, RL2 and RL3 from the central point of the hub 120 to the inflection points of the leading edge line L.E.L., an equation $RL1<RT1<1.26RL1$, $RL2<RT2<1.26RL2$, or $RL3<RT3<1.26RL3$ is satisfied.

Under the above construction, on the other hand, diffusion angles θ1, θ2 and θ3, which are formed between lines L1, L3 and L5 of same radius circles C1, C2 and C3 formed relative to the central portion of the hub 120 on the inflection points of the leading edge line (L.E.L) and the connected lines L2, L4 and L6 among the three pairs of inflection points, become gradually increased it is goes from the blade root toward the blade tip.

More preferably, the diffusion angles θ1, θ2 and θ3 are formed within a range from 0° to 50°.

Otherwise, the diffusion angles θ1, θ2 and θ3 may be formed at the same angle as one another from the blade root toward the blade tip.

In other words, the diffusion angles θ1, θ2 and θ3 may be formed at the same angle ranging from 0° to 50°.

In this case, the radius RL1, RL2 and RL3 are at the positions where the inflection points are formed on the leading edge line (L.E.L), and the radius RT1, RT2 and RT3 are at the positions where the inflection points are formed on the trailing edge line (T.E.L). And, PT1, PT2 and PT3 are the points where the leading edge line L.E.L. meets the radius RL1, RL2 and RL3, and PT1', PT2' and PT3' are the points where the trailing edge line (T.E.L) meets the radius RL1, RL2 and RL3. The lines L1, L3 and L5 are those on which the RL1, RL2 and RL3 are connected to the points PT1~PT1', PT2~PT2' and PT3~PT3' where the leading edge line (L.E.L) meets the trailing edge line (T.E.L), and the lines L2, L4 and L6 are those on which the inflection points PT1, PT2 and PT3 of the leading edge line (L.E.L) are connected to the inflection points PT4, PT5 and PT6 of the trailing edge line (T.E.L). The diffusion angles θ1, θ2 and θ3 are those between L1 and L2, between L3 and L4, and between L5 and L6.

Figure 1:
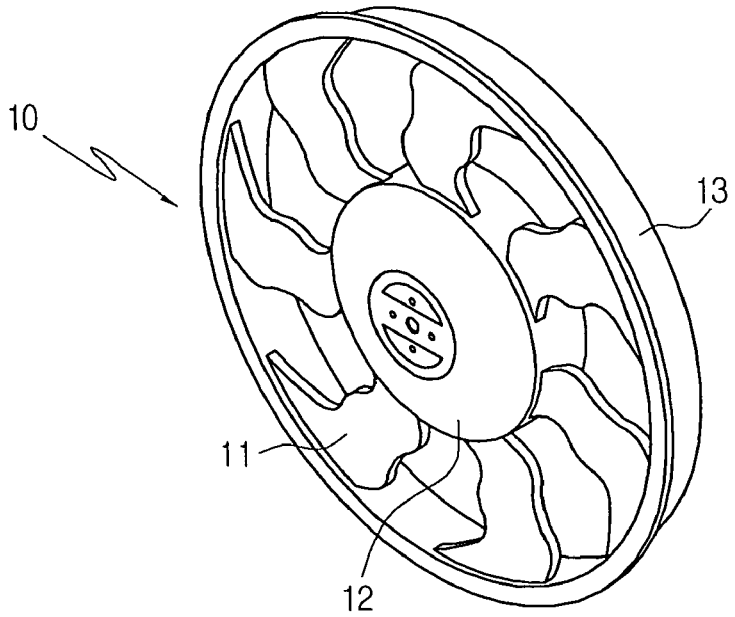
FIG. 1 is a perspective view of the outer appearance of the axial-flow fan according to the prior art.
Figure 2:
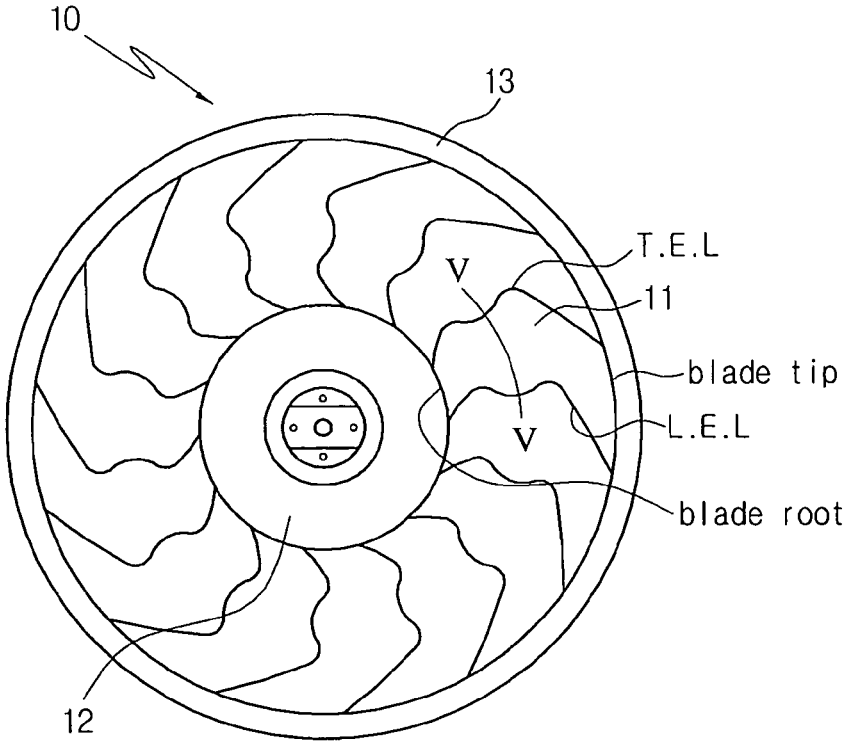
FIG. 2 is a front view of the axial-flow fan of FIG. 1.
Figure 3:
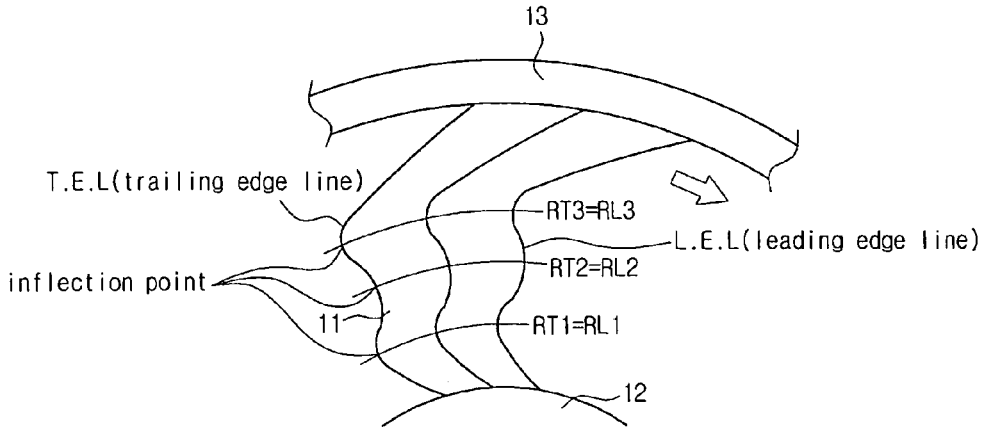
FIG. 3 is an enlarged front view of a part of the plurality of blades of FIG. 1.
Figure 4:
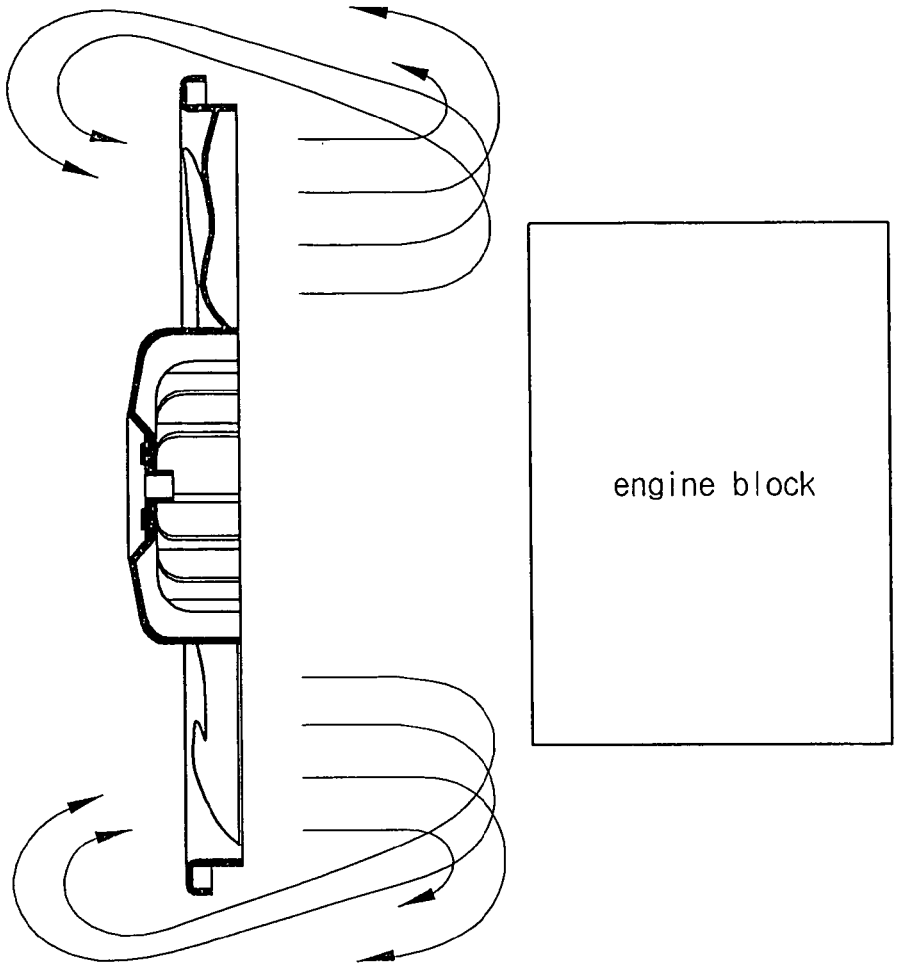
FIG. 4 is a view illustrating the direction of airflow through the axial-flow fan of FIG. 1.

Under the above construction, according to the axial-flow fan of the present invention a stream of airflow does not go straight to an axial direction as shown in FIG. 4, but it goes outside the axial-flow fan, while not going toward the engine block, as shown in FIG. 9.

In more detail, the stream of airflow through the axial-flow fan is produced, while not colliding against the structure like an engine in the engine room.

Therefore, since the stream of airflow does not collide against the engine block, it does not flow back such that it is not recirculated to the heat exchanger. This prevents hot air from being introduced into the heat exchanger, thereby greatly improving performance of the heat exchanger such that engine cooling is achieved efficiently.

And, since the steam of airflow through the axial-flow fan bypasses through the engine block, without having a directly contact with the engine block, the present invention can get rid of the conventional problem that the steam of airflow produced through the axial-flow fan collides against the engine block, becomes hot and flows back thereto to thereby make the cooling performance of the heat exchanger substantially deteriorated.

INDUSTRIAL APPLICABILITY

As set forth in the foregoing, there is provided an axial-flow fan in which a steam of airflow through the fan is produced around an engine, without any direct collision against the engine in an engine room and is not recirculated to a heat exchanger, thereby greatly improving performance of the heat exchanger such that engine cooling is achieved efficiently.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. An axial-flow fan having a central hub coupled to a rotational shaft of a motor, a plurality of blades extending radially outwardly from the outer circumference of the hub for blowing air in an axial direction, the plurality of blades being integrated with the hub into a single body, each of the plurality of blades having a leading edge line (L.E.L.) and a trailing edge line (T.E.L.) that are formed in a corrugated shape along almost the same direction to each other and have at least two or more pairs of inflection points formed along the lines, wherein the inflection points of the trailing edge line (T.E.L.) formed on each of the plurality of blades are placed in such a manner as to be closer to a blade tip than those of the leading edge line (L.E.L.) formed on each of the plurality of blades.

2. The axial-flow fan according to claim 1, wherein a ratio of radius (RT) ranging from the central point of the hub to the inflection point of the trailing edge line to radius (RL) ranging from the central point of the hub to the inflection point of the leading edge line, on each pair of inflection points, satisfies $1 < RT/RL < 1.16$.

3. The axial-flow fan according to claim 1, wherein diffusion angles (θ1, θ2 and θ3), which are formed between lines (L1, L3 and L5) of same radius circles (C1, C2 and C3) formed relative to the central portion of the hub on the inflection points of the leading edge line and the connected lines (L2, L4 and L6) among the three pairs of inflection points, become gradually increased as it goes from a blade root toward a blade tip.

4. The axial-flow fan according to claim 1, wherein diffusion angles (θ1, θ2 and θ3), which are formed between lines (L1, L3 and L5) of same radius circles (C1, C2 and C3) formed relative to the central portion of the hub on the inflection points of the leading edge line and the connected lines (L2, L4 and L6) among the three pairs of inflection points, are the same as one another from the blade root toward the blade tip.

5. The axial-flow fan according to claim 3, wherein each of the diffusion angles (θ1, θ2 and θ3) has a maximum angle of 50°.

6. The axial-flow fan according to claim 4, wherein each of the diffusion angles (θ1, θ2 and θ3) has a maximum angle of 50°.

* * * * *